US009091443B2

(12) United States Patent
Hatano

(10) Patent No.: US 9,091,443 B2
(45) Date of Patent: Jul. 28, 2015

(54) GLOW PLUG AND METHOD FOR MANUFACTURING GLOW PLUG

(75) Inventor: Gaku Hatano, Inuyama (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 628 days.

(21) Appl. No.: 13/357,066

(22) Filed: Jan. 24, 2012

(65) Prior Publication Data

US 2012/0187101 A1 Jul. 26, 2012

(30) Foreign Application Priority Data

Jan. 25, 2011 (JP) ..... 2011-013384

(51) Int. Cl.

| | |
|---|---|
| ***F23Q 7/00*** | (2006.01) |
| ***F23Q 7/22*** | (2006.01) |
| ***H05B 3/06*** | (2006.01) |
| ***H05B 3/44*** | (2006.01) |
| ***H05B 3/02*** | (2006.01) |
| ***F02P 19/02*** | (2006.01) |

(52) U.S. Cl.

CPC ..... *F23Q 7/001* (2013.01); *Y10T 29/49083* (2015.01)

(58) Field of Classification Search

CPC ..... F23Q 7/001; F23Q 7/00; F23Q 2007/002; F23Q 2007/004; F23Q 7/22; H05B 3/141; H05B 2203/027; H05B 3/44; F02P 19/025; F02P 19/028; G01L 23/10; G01L 23/222; Y10T 29/49083; H01C 17/02; A24F 47/008

USPC ..... 219/260, 552, 544, 270, 261–265, 219/267–269; 411/120; 123/179.6

IPC ..... F23Q 7/00; F16B 39/10

See application file for complete search history.

(56) References Cited

U.S. PATENT DOCUMENTS

| | | | | |
|---|---|---|---|---|
| 2,510,308 | A * | 6/1950 | Dante | 219/266 |
| 2,884,920 | A * | 5/1959 | Moule et al. | 123/145 R |
| 2,885,859 | A * | 5/1959 | Barberis | 60/39.826 |

(Continued)

FOREIGN PATENT DOCUMENTS

| | | | |
|---|---|---|---|
| JP | 200213736 | A | 1/2002 |
| JP | 2005-315474 | A | 11/2005 |
| JP | 2007292444 | A | 11/2007 |

OTHER PUBLICATIONS

Office Action dated Dec. 9, 2014, issued by the Japanese Intellectual Property Office in counterpart Japanese Application No. 2011-013384.

*Primary Examiner* — Sang Y Paik
*Assistant Examiner* — Gyounghyun Bae
(74) *Attorney, Agent, or Firm* — Sughrue Mion, PLLC

(57) ABSTRACT

A glow plug which includes an intermediate shaft (3) inserted into a shaft hole (43) of a metal shell (4) and having a connecting end part (36) of a rear end part (32) protruding from a rear end surface (48). An insulating member (6) is arranged between the intermediate shaft (3) and the shaft hole (43) of the metal shell (4). The insulting member (6) has a tapered part (63) which abuts a tapered part (47) provided in the metal shell (4). The insulating member (6) is pressed into position by a connecting terminal (5) fixed to the connecting end part (36) to assuredly hold the intermediate shaft (3) in a rear end part (45) of the metal shell (4) and to thereby prevent a deflection or bend of the intermediate shaft (3). Also disclosed is a method for manufacturing the glow plug.

5 Claims, 4 Drawing Sheets

(56) References Cited

U.S. PATENT DOCUMENTS

| | | | | | |
|---|---|---|---|---|---|
| 2,924,642 | A * | 2/1960 | Dart | 174/152 S |
| 4,170,922 | A * | 10/1979 | Peterson et al. | 89/7 |
| 4,423,309 | A * | 12/1983 | Murphy et al. | 219/270 |
| 4,582,981 | A * | 4/1986 | Brooks et al. | 219/270 |
| 4,733,053 | A * | 3/1988 | Mueller | 219/270 |
| 5,880,432 | A * | 3/1999 | Radmacher | 219/270 |
| 6,064,039 | A * | 5/2000 | Kumada | 219/270 |
| 6,148,660 | A * | 11/2000 | Chiu et al. | 73/35.08 |
| 6,610,964 | B2 * | 8/2003 | Radmacher | 219/270 |
| 6,657,166 | B2 * | 12/2003 | Funaki et al. | 219/270 |
| 6,844,525 | B2 * | 1/2005 | Yoshikawa et al. | 219/270 |
| 6,849,207 | B2 * | 2/2005 | Funaki et al. | 252/516 |
| 7,004,134 | B2 * | 2/2006 | Higuchi | 123/149 D |
| 7,020,952 | B2 * | 4/2006 | Watanabe et al. | 29/613 |
| 7,223,942 | B2 * | 5/2007 | Konishi et al. | 219/270 |
| 7,319,208 | B2 * | 1/2008 | Gotoh et al. | 219/270 |
| 7,560,666 | B2 * | 7/2009 | Ando | 219/270 |
| 7,635,826 | B2 * | 12/2009 | Yamada et al. | 219/270 |
| 7,675,005 | B2 * | 3/2010 | Annavarapu et al. | 219/270 |
| 7,705,273 | B2 * | 4/2010 | Hotta et al. | 219/270 |
| 8,378,273 | B2 * | 2/2013 | Sekiguchi et al. | 219/552 |
| 2001/0015402 | A1 * | 8/2001 | Murai et al. | 248/554 |
| 2001/0029916 | A1 * | 10/2001 | Kanao | 123/169 EL |
| 2002/0036192 | A1 * | 3/2002 | Sato et al. | 219/270 |
| 2002/0185485 | A1 * | 12/2002 | Radmacher | 219/270 |
| 2004/0124754 | A1 * | 7/2004 | Yoshikawa et al. | 313/118 |
| 2004/0206742 | A1 * | 10/2004 | Duba | 219/270 |
| 2005/0211214 | A1 * | 9/2005 | Tomita et al. | 123/145 A |
| 2006/0011602 | A1 * | 1/2006 | Konishi et al. | 219/270 |
| 2007/0151096 | A1 * | 7/2007 | Walker et al. | 29/611 |
| 2007/0210053 | A1 * | 9/2007 | Hotta et al. | 219/270 |
| 2007/0241092 | A1 * | 10/2007 | Suzuki | 219/260 |
| 2009/0179027 | A1 * | 7/2009 | Vartabedian et al. | 219/548 |

* cited by examiner

GLOW PLUG AND METHOD FOR MANUFACTURING GLOW PLUG

BACKGROUND OF THE INVENTION

1. Field of the Invention

The present invention relates to a glow plug used for assisting start-up of a diesel engine and a method for manufacturing the glow plug.

2. Description of the Related Art

A glow plug used for assisting start-up of a diesel engine directly holds a heater having a heat generating resistor in an end part thereof which is in an end part of a tubular metal shell having a shaft hole, or the glow plug indirectly holds the heater via a holding member. In the shaft hole of the metal shell, a rod shaped intermediate shaft is inserted and arranged in an insulated state from the metal shell. One end part of the intermediate shaft is connected to a rear end part of the heater and the other end part protrudes from a rear end of the metal shell. Two electrodes taken out from the heater are electrically connected to the metal shell and the intermediate shaft, respectively.

A tubular insulator (an insulating member) is arranged in the rear end part of the metal shell, between the shaft hole and the intermediate shaft. The insulator has a collar part in a rear end side, and the collar part is held between a pin terminal or a circular nut attached to the other end part of the intermediate shaft and the rear end part of the metal shell to position the insulator. Thus, a part of the end side of the insulator from the collar part is arranged between the shaft hole and the intermediate shaft to ensure an insulating state between the metal shell and the intermediate shaft (for example, see Patent Literature 1). Further, in the rear end part of the metal shell, a seal member pressed and positioned by the insulator is arranged between the shaft hole and the intermediate shaft so that air-tightness in the shaft hole is ensured.

[Patent Literature 1] JP-A-2005-315474

3. Problems to be Solved by the Invention

However, the insulator used in a typical glow plug is formed in such a size as to provide a clearance between the insulator and the shaft hole and between the insulator and the intermediate shaft, respectively. In this manner, ease in an assembling operation is ensured during production. Therefore, in the rear end part of the metal shell, the intermediate shaft is of a form so as to be held by the seal member in a radial direction in the shaft hole. When a load is applied to the intermediate shaft due to vibration when driving a vehicle or due to attachment of a connector for supply of electric current, if the seal member is elastically deformed so that the intermediate shaft is deflected or bent in the shaft hole, there is a concern that stress may be applied to the heater connected to the one end part of the intermediate shaft.

SUMMARY OF THE INVENTION

The present invention has been made in order to solve the above-described problems, and an object thereof is to provide a glow plug and a method for manufacturing the glow plug that can assuredly hold an intermediate shaft in a shaft hole of a metal shell so as to prevent deflection or bending of the intermediate shaft in a radial direction.

The above object according to a first aspect (1) of the invention has been achieved by providing a glow plug comprising a heater having a heat generating resistor that generates heat by passing an electric current therethrough; a metal shell formed in a tubular shape having a shaft hole extending in an axial direction and which directly holds the heater in a front end part thereof or indirectly through a holding member; an intermediate shaft formed in the shape of a rod, arranged in the shaft hole of the metal shell with a clearance provided relative to an inner peripheral surface of the metal shell and which has one end part thereof connected to a rear end part of the heater and the other end part thereof protruding from a rear end of the metal shell; and a cylindrical insulator arranged between the shaft hole of the metal shell and the intermediate shaft, which insulator is urged toward the front end of the metal shell in the axial direction and positioned by a fixing part provided in the other end part of the intermediate shaft, further including: a first tapered part that is provided in the inner peripheral surface of the metal shell in a rear end part of the metal shell and which expands from the shaft hole to an opening of the shaft hole; and a second tapered part that is provided in an outer peripheral surface of the insulator, expands from an end side to a rear end side of the insulator and abuts the first tapered part.

According to the above first aspect of the invention, since the insulator arranged between the shaft hole of the metal shell and the intermediate shaft is urged from the rear end side towards the front end side, the second tapered part abuts the first tapered part of the metal shell. A resistance force (namely, a force having a radial component) is generated in a vertical direction to the abutting surface. Thus, the insulator is arranged in a state having a radial resistance force (in other words, in a close contact state) to the metal shell. Since the other end part of the intermediate shaft is assuredly held by the insulator in the shaft hole in the rear end part of the metal shell, a deflection or bend of the intermediate shaft can be prevented. Further, since the intermediate shaft is held by the insulator in the rear end part of the metal shell, a stress (load) applied to the heater connected to the one end part of the intermediate shaft can be reduced. Since a seal member such as an O ring is ordinarily provided in an end side of a typical insulator so that the insulator merely serves to press the seal member, the insulator is not contemplated to support the intermediate shaft in a radial direction. Accordingly, clearances are formed respectively between the typical insulator and the intermediate shaft and between the typical insulator and the shaft hole of the metal shell. However, according to the first aspect of the present invention, at least a part is provided in which the insulator is in close (intimate) contact with the shaft hole (i.e., no gaps). Accordingly, the deflection, bend or the like of the intermediate shaft can be suppressed to a greater extent than by a typical intermediate shaft.

In a preferred embodiment (2) according to (1) above, the insulator is arranged between the shaft hole and the intermediate shaft in a state in which the insulator is in close contact with the intermediate shaft. Since a clearance is not formed between the insulator and the intermediate shaft, when the insulator is positioned and fixed in the shaft hole in the rear end part of the metal shell, the other end part of the intermediate shaft can be assuredly held.

In another preferred embodiment (3) according to (1) or (2) above, a rear end surface of the insulator abuts an end surface of the fixing part, and when a maximum outside diameter of the first tapered part of the metal shell is D1, a maximum outside diameter of the second tapered part of the insulator is D2, a maximum outside diameter of the rear end surface of the insulator is D3 and a maximum outside diameter of the end surface of the fixing part is D4, the relations of D1>D2 and D3<D4 are satisfied.

When the relation of D1>D2 is satisfied, an edge part formed by the rear end surface and the first tapered part of the metal shell is arranged radially outside the second tapered part of the insulator. Therefore, since the edge part formed by the rear end surface and the first tapered part of the metal shell does not butt against the insulator (especially, the second tapered part) to apply a stress thereto, such structure can prevent the insulator from being ground or abraded due to a concentration of stress. Further, when the relation of D3<D4 is satisfied, an edge part formed by a side surface and the end surface of the fixing part is arranged radially outside the rear end surface of the insulator. Accordingly, since the edge part formed by the side surface and the end surface of the fixing part does not butt against the rear end surface of the insulator to apply a stress thereto, deterioration of the insulator by grinding or abrasion due to the concentration of stress can be prevented.

In a second aspect (4), the invention provides a method for manufacturing a glow plug which comprises a heater having a heat generating resistor that generates heat by passing an electric current therethrough; a metal shell formed in a tubular shape having a shaft hole extending in an axial direction and which directly holds the heater in a front end part thereof or indirectly through a holding member; an intermediate shaft formed in the shape of a rod, arranged in the shaft hole of the metal shell with a clearance provided relative to an inner peripheral surface of the metal shell and which has one end part thereof connected to a rear end part of the heater and the other end part thereof protruding from a rear end of the metal shell; and a cylindrical insulator arranged between the shaft hole of the metal shell and the intermediate shaft, which insulator is urged toward the front end of the metal shell in the axial direction and positioned by a fixing part provided in the other end part of the intermediate shaft, further including: a first tapered part that is provided in the inner peripheral surface of the metal shell in a rear end part of the metal shell and which expands from the shaft hole to an opening of the shaft hole; and a second tapered part that is provided in an outer peripheral surface of the insulator, expands from an end side to a rear end side of the insulator and abuts the first tapered part, wherein the intermediate shaft includes a connecting base part whose outside diameter is larger than that of the other end part of the intermediate shaft and a shoulder part having a taper that connects the other end part of the intermediate shaft to the connecting base part in a state before the insulator is arranged between the shaft hole of the metal shell and the intermediate shaft; an inside diameter A1 of a tubular hole of the insulator, an outside diameter A2 of the other end part of the intermediate shaft and an outside diameter A3 of the connecting base part satisfy a relation of A2<A1<A3; and an end position B1 of the shoulder part of the intermediate shaft is located closer to a rear end side in the axial direction than an end position B2 of the first tapered part of the metal shell, said method which includes arranging the insulator between the shaft hole of the metal shell and the intermediate shaft comprises: an inserting step of providing the insulator around the other end part of the intermediate shaft; an arranging step of pressing the insulator to the shoulder part so as to expand the tubular hole and further arranging the insulator onto the connecting base part; and an abutting step that further pushes the insulator onto the connecting base part so that the second tapered part abuts the first tapered part of the metal shell.

A surface work may be occasionally applied to the other end part of the intermediate shaft for providing the fixing part. Since the relation of A2<A1 is established, when the insulator is inserted to the other end part of the intermediate shaft in an inserting step, such arrangement can prevent the inner peripheral surface of the insulator from being rubbed by the other end part so as not to be broken. In an arranging step, when the relation of A1<A3 is satisfied, since the insulator in which the inside diameter of the tubular hole is expanded in the shoulder part can be arranged on the connecting base part, the inner periphery of the insulator can be in close contact with the outer periphery of the connecting base part. Thus, a clearance is not formed between the insulator and the connecting base part. Further, since B2 is located closer to the end side than B1 in the axial direction, the insulator can be arranged closer to the end side of the connecting base part until the second tapered part of the insulator abuts the first tapered part of the metal shell in an abutting step. Thus, an abutting area between an outer peripheral surface of the connecting base part of the intermediate shaft and an inner peripheral surface of the insulator can be increased. Then, in the abutting step, when the second tapered part of the insulator abuts the first tapered part of the metal shell, a resistance force is generated in a vertical direction to the abutting surface. The resistance force has a radial component. Further, since the inner periphery of the insulator is in close contact with the outer periphery of the connecting base part as described above, the insulator can be arranged in a state in which the radial resistance force (in other words, in a close contact state allowing for no gaps) is applied to each of the connecting base part of the intermediate shaft and the first tapered part of the metal shell. Accordingly, since the other end part of the intermediate shaft is assuredly held by the insulator in the shaft hole in the rear end part of the metal shell, the deflection or bend of the intermediate shaft can be prevented. Further, since the intermediate shaft is held by the insulator at the rear end part, a stress (load) applied to the heater connected to the one end part can be reduced. Further, in a production step, an axis of the intermediate shaft can be easily aligned with an axis of the metal shell, that is, a glow plug main body.

DETAILED DESCRIPTION OF THE PREFERRED EMBODIMENTS

Now, an exemplary embodiment of a glow plug and a method for manufacturing a glow plug that embody the present invention will be described below by reference to the drawings. In reference to FIG. 1 and FIG. 2, an entire structure of a glow plug 1 as one example will be described. The drawings referred to herein are used for explaining technical features which can be employed by the present invention. However, the invention should not be construed as being limited thereto. In the explanation below, in a direction of an axis O, a side (a lower side in FIG. 1) in which a ceramic heater 2 is arranged is set as an end side of the glow plug 1.

Figure 1:
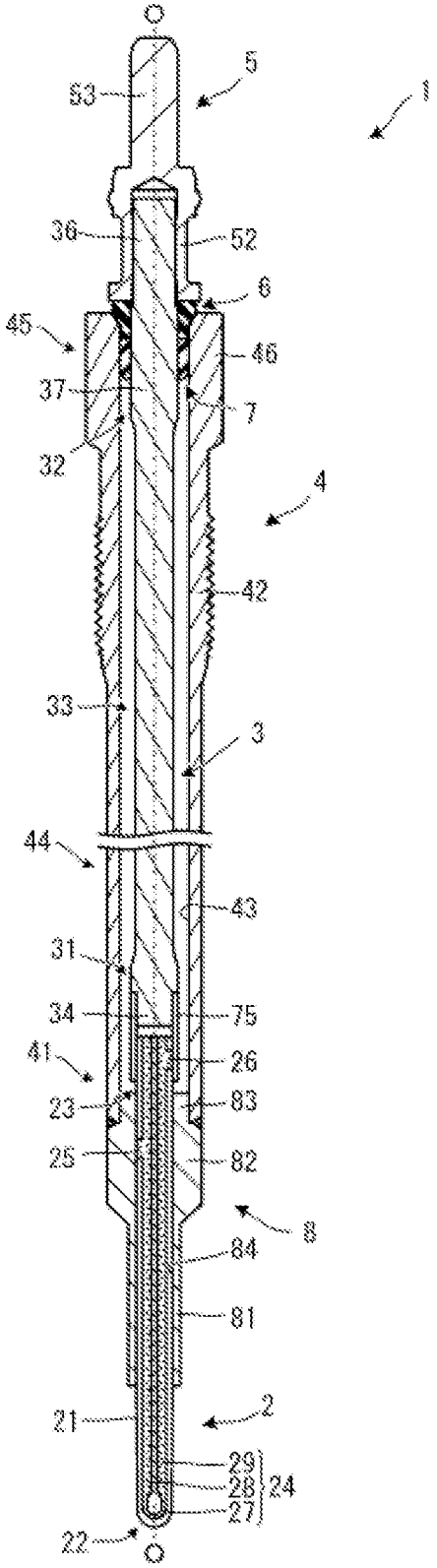
FIG. 1 is a longitudinally sectional view of a glow plug 1.

The glow plug 1 shown in FIG. 1 is attached to a combustion chamber (not shown in the drawing) of, for instance, a direct injection type diesel engine and used as a heat source for assisting ignition during start-up of the engine. The glow plug 1 includes a metal shell 4, a holding member 8, a ceramic heater 2, an intermediate shaft 3, a connecting terminal 5, an insulating member 6 and an O ring 7.

Initially, the ceramic heater 2 will be described. The ceramic heater 2 is formed in the shape of a circular rod and has a base body 21 formed from an insulating ceramic and having an end part 22 hemi-spherically curved. In the base body 21, a heat generating element 24 is buried which is formed from an electrically conductive ceramic and has a substantially U shaped section. The heat generating element 24 includes a heat generating resistor 27 and lead parts 28 and 29. The heat generating resistor 27 is arranged in the end part 22 of the ceramic heater 2, and both ends thereof are folded back substantially in the U shape corresponding to the curved surface of the end part 22. The lead parts 28 and 29 are respectively connected to both ends of the heat generating resistor 27 and extended to a rear end part 23 of the ceramic heater 2 substantially in parallel with each other. A sectional area of the heat generating resistor 27 is formed so as to be smaller than a sectional area of the lead parts 28 and 29. When an electric current is supplied, heat is generated mainly in the heat generating resistor 27. Further, in a rear end side from a central part of the ceramic heater 2, electrode connection pans 25 and 26 protrude in a radial direction respectively from the lead parts 28 and 29. The electrode connection parts 25 and 26 are exposed at positions offset from each other in the axial direction O on an outer peripheral surface of the ceramic heater 2.

Now, the holding member 8 will be described. The holding member 8 is formed from a cylindrical metal member extending in the axial direction O and radially holds a body part of the ceramic heater 2 in its tubular hole 84. The end part 22 and the rear end part 23 of the ceramic heater 2 are respectively exposed from both ends of the holding member 8. In a rear end side of a body part 81 of the holding member 8, a thick collar part 82 is formed. In a rear end of the collar part 82, a stepped shell engaging part 83 is formed which engages an end part 41 of the below-described metal shell 4. The electrode connection part 25, which is formed in the end side, of the electrode connection parts 25 and 26 of the ceramic heater 2, is in contact with an inner peripheral surface of the holding member 8. In this manner, the electrode connection part 25 is electrically connected to the holding member 8.

Further, a tubular connection ring 75 made of metal is fitter to the rear end part 23 of the ceramic heater 2 by pressing, which rear end part 23 is exposed from the rear end side of the shell engaging part 83 of the holding member 8. The electrode connection part 26 of the ceramic heater 2 is in contact with an inner peripheral surface of the connecting ring 75 so that the electrode connection part 26 is electrically connected to the connecting ring 75. The end part 41 of the below-described metal shell 4 is connected to the shell engaging part 83 of the holding member 8 so that the electrode connection part 25 is electrically connected to the metal shell 4. The connecting ring 75 connected to the electrode connection part 26 is arranged in the metal shell 4. However, the ceramic heater 2 and the metal shell 4 are positioned by the holding member 8, so that the connecting ring 75 and the metal shell 4 are directly maintained in an insulated state.

Figure 2:
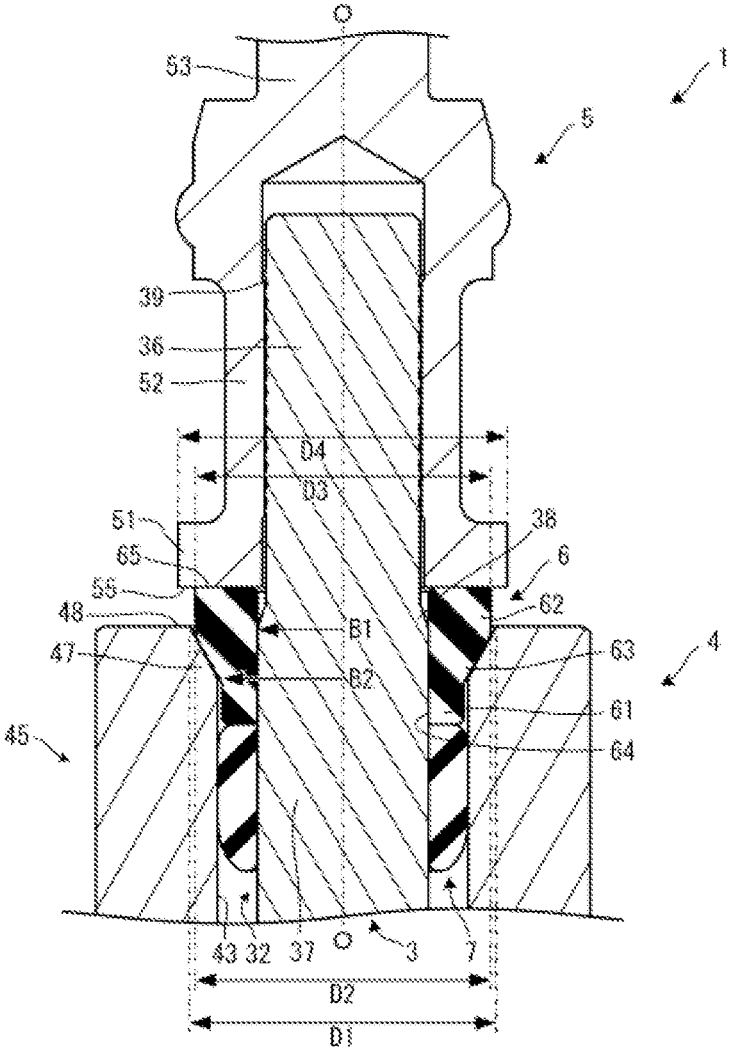
FIG. 2 is a sectional view showing an enlarged rear end side of the glow plug 1.

Now, the metal shell 4 will be described below. The metal shell 4 is an elongated tubular metal member having a shaft hole 43 passing through in the axial direction O. The end part 41 of the metal shell 4 has an inner periphery engaged with an outer periphery of the above-described shell engaging part 83 of the holding member 8 and is electrically connected to the electrode connection part 25 of the ceramic heater 2 through the holding member 8. To an engaged part of the end part 41 and the shell engaging part 83, a laser welding is applied to integrally connect the metal shell 4 to the holding member 8. An intermediate body part 44 between the end part 41 and a rear end part 45 of the metal shell 4 is formed to extend a relatively long distance in the axial direction O. In an outer peripheral surface of a rear end side, an attaching part 42 is provided which has screw threads formed for attaching the glow plug 1 to an engine head (not shown in the drawing) of an internal combustion engine. In a rear end side of the attaching part 42, a tool engaging part 46 (with which a tool used when the glow plug 1 is attached to the engine head is engaged) is formed with a hexagonal shape in section. As shown in FIG. 2, in an inner peripheral surface of the rear end part 45 of the metal shell 4, a tapered part 47 is formed which expands in a tapered shape to an opening of a rear end surface 48 from the shaft hole 43. A narrow angle formed by the tapered part 47 and the axis O is preferably set to 20° or larger and 70° or smaller. In this exemplary embodiment, the angle is set to 30°. When the angle is set within this range, stability of the insulating member 6 during its attachment and an advantage for centering the intermediate shaft 3 by the insulating member 6 can be more effectively obtained.

Now, the intermediate shaft 3 will be described below. As shown in FIG. 1, the intermediate shaft 3 is a rod shaped metal member extending in the axial direction O and inserted into the shaft hole 43 of the metal shell 4. In an intermediate body part 33 between an end part 31 and a rear end part 32 of the intermediate shaft 3, an outside diameter thereof is formed to be smaller than that of the end part 31 and the rear end part 32. In the end part 31, a ring engaging part 34 of small diameter is formed which engages an inner periphery of the connecting ring 75 in an end thereof. The ring engaging part 34 engages the connecting ring 75, so that the ceramic heater 2 is connected integrally to the intermediate shaft 3 through the connecting ring 75 along the axis O. Although not shown in the drawing, to an engaged part of the end part 31 and the connecting ring 75, a laser welding is applied to integrally connect the end part 31 to the connecting ring 75. Thus, the intermediate shaft 3 is electrically connected to the electrode connection part 26 of the ceramic heater 2 through the connecting ring 75. As described above, since the ceramic heater 2 and the metal shell 4 are positioned by the holding member 8, the intermediate shaft 3 and the metal shell 4 are directly maintained in an insulated state in the shaft hole 43.

As shown in FIG. 2, the rear end part 32 of the intermediate shaft 3 includes a connecting end part 36 protruding from the rear end surface 48 of the metal shell 4 and a connecting base part 37 that connects the connecting end part 36 to the intermediate body part 33. In the connecting end part 36, an engaging part 39 is formed that has an outer peripheral surface to which a knurling surface work (see FIG. 3) is applied. An outside diameter of the connecting end part 36 including the engaging part 39 is smaller than an outside diameter of the connecting base part 37. Between the connecting end part 36 and the connecting base part 37, a shoulder part 38 having a tapered shape is formed that connects the connecting end part 36 to the connecting base part 37.

In the rear end part 32 of the intermediate shaft 3, the O ring 7 and the insulating member 6 are arranged. The O ring 7 is provided to maintain air-tightness in the shaft hole 43 of the metal shell 4. The O ring 7 is formed in an annular shape by a member having heat resistance, an insulating property and elasticity, for instance, from a material such as fluorine rubber, acryl rubber, silicone rubber or the like.

The insulating member 6 is formed from a member having heat resistance and an insulating property, for instance, NYLON (a registered trademark) in order to prevent a short circuit due to contact of the metal shell 4, the intermediate shaft 3 and the connecting terminal 5 (described below). The insulating member 6 is formed in a cylindrical shape having a tubular hole 64 extending in the axial direction O. In the insulating member 6, an outside diameter of an end body part 61 in an end side in the axial direction O is different from an outside diameter of a rear end body part 62 in a rear end side. The outside diameter of the end body part 61 is formed so as to be smaller than the outside diameter of the rear end body part 62. A part between the end body part 61 and the rear end body part 62 is formed as a tapered part 63 expanding in a tapered shape from the end side (the end body part 61 side) to the rear end side (the rear end body part 62 side). When the rear end part 32 of the intermediate shaft 3 is inserted into the tubular hole 64 of the insulating member 6, the tapered part 63 of the insulating member 6 is arranged so as to abut the tapered part 47 of the metal shell 4. Thus, the metal shell 4 and the intermediate shaft 3 are maintained in an insulated state.

To the connecting end part 36 of the intermediate shaft 3, the connecting terminal 5 is fixed. The connecting terminal 5 has a cap shaped body part 52 with which the connecting end part 36 is covered and a pin shaped protruding part 53 protruding to a rear end side from the body part 52. In an opening end of the end of the body part 52, a collar part 51 is formed which protrudes in a radial direction over a circumference. When the connecting end part 36 of the intermediate shaft 3 is covered with the connecting terminal 5, the connecting terminal 5 is arranged so that the collar part 51 abuts a rear end surface 65 of the insulating member 6. Thus, the metal shell 4 and the connecting terminal 5 are maintained in an insulated state. Further, in a state in which the connecting terminal 5 is pressed toward an end in the axial direction, the connecting terminal 5 is crimped inward from an outer periphery of the body part 52. Thus, an inner peripheral surface of the body part 52 strongly engages the engaging part 39 of the connecting end part 36. Since the engaging part 39 has a knurled shape, a fixing force of the body part 52 to the engaging part 39 is improved which is attached under pressure to the engaging part 39 by crimping. Thus, the connecting terminal 5 and the intermediate shaft 3 are integrally fixed and both members are electrically connected to each other. To the protruding part 53 of the connecting terminal 5, a plug cap (not shown in the drawing) is fitted when the glow plug 1 is attached to the engine head (not shown in the drawing). The heat generating element 24 (see FIG. 1) of the ceramic heater 2 generates heat upon supplying an electric current between one end side of the heat generating resistor 27 grounded to the engine through the holding member 8 and the metal shell 4 and the other end side connected to the plug cap through the connecting terminal 5 and the intermediate shaft 3.

The glow plug 1 having the above-described structure is generally assembled as described below. An element molded product as an original form of the heat generating element 24 of the ceramic heater 2 is made by injection molding using a material such as an electrically conductive ceramic powder or a binder. Further, a base body molded product as an original form of the base body 21 of the ceramic heater 2 is fashioned as a two-divided molded product by a die press molding using an insulating ceramic powder as a molding material. In a state in which the element molded product is held and accommodated by the base body molded product, the element molded product is compressed using a press. Thus, the rod shaped ceramic heater 2 having a hemispherical end is formed by polishing an outer peripheral surface via a binder removing process and a hot press burning process.

The ceramic heater 2 is fitted into the connecting ring 75 formed in the shape of a pipe from a steel material such as stainless steel by pressing and the connecting ring 75 is electrically connected to the electrode connection part 26. Similarly, the ceramic heater 2 is fitted into the holding member 8 formed to a prescribed shape by pressing, so that the holding member 8 is electrically connected to the electrode connection part 25. On the other hand, the intermediate shaft 3 is formed by applying a plastic work or a cutting work to a rod shaped member made of an iron type material (for instance, Fe—Cr—Mo steel) cut to a prescribed dimension. In a state in which the ring engaging part 34 of the intermediate shaft 3 engages the connecting ring 75 fitted to the ceramic heater 2, the laser welding is applied to the engaged part to integrally connect the intermediate shaft 3 to the ceramic heater 2.

The tubular metal shell 4 is formed from an iron type material such as S45C, and the screw threads are formed on the attaching part 42 by rolling. Further, in the inner peripheral surface of the rear end part 45 of the metal shell 4, the tapered part 47 is formed which expands in the tapered shape to the opening of the rear end surface 48 from the shaft hole 43. The intermediate shaft 3 formed integrally with the ceramic heater 2 is inserted into the shaft hole 43 of the metal shell 4. Laser welding is applied to the engaged position of the metal shell 4 and the holding member 8, to integrally connect the metal shell 4 to the holding member 8.

The O ring 7 is fitted to the rear end part 32 of the intermediate shaft 3 protruding from the rear end surface 48 of the metal shell 4 and arranged between the shaft hole 43 of the metal shell 4 and the connecting base part 37. The tubular hole 64 of the insulating member 6 is inserted to the rear end part 32 of the intermediate shaft 3. As described below, an inside diameter A1 of the tubular hole 64 is larger than an outside diameter A2 of the connecting end part 36 (see FIG. 3). This structure prevents the insulating member 6 from rubbing an inner peripheral surface of the insulator member 6 so as not to be broken by a surface work of the engaging part 39 of the connecting end part 36. The insulating member 6 is inserted onto the connecting end part 36 (an inserting step) and reaches the shoulder part 38. As described below, the inside diameter A1 of the tubular hole 64 is smaller than an outside diameter A3 of the connecting base part 37 (see FIG. 3). The insulating member 6 is pressed against the shoulder part 38 so that the tubular part 64 expands along the tapered part of the shoulder part 38. The insulating member 6 is further pushed in and arranged onto the connecting base part 37 whose outside diameter is larger than the outside diameter of the connecting end part 36 (an arranging step). The connecting end part 36 of the intermediate shaft 3 is covered with the body part 52 of the connecting terminal 5 and an end surface 55 of the collar part 51 abuts the rear end surface 65 of the insulating member 6. When the connecting terminal 5 is pressed toward the front end side in the axial direction O, the tapered part 63 of the insulating member 6 abuts the tapered part 47 of the metal shell 4. Thus, a resistance force is generated in the abutting surfaces of the tapered parts 47 and 63 (an abutting step). In this state, the body part 52 of the connecting terminal 5 is crimped, and the connecting terminal 5 is fixed to the connecting end part 36 of the intermediate shaft 3 to complete the glow plug 1.

In the intermediate shaft 3 of the glow plug 1 assembled in such a manner, as described above, the end part 31 is fixed to the ceramic heater 2 through the connecting ring 75. The ceramic heater 2 is held by the holding member 8 connected to the end part 41 of the metal shell 4. Accordingly, the intermediate shaft 3 is positioned and held in the end part 41 of the metal shell 4. On the other hand, the rear end part 32 of the intermediate shaft 3 is arranged in the rear end part 45 of the metal shell 4. Since the insulating member 6 is arranged between an inner peripheral surface of the shaft hole 43 in the rear end part 45 and an outer peripheral surface of the rear end part 32 of the intermediate shaft 3, the metal shell 4 and the intermediate shaft 3 are maintained in an insulated state. In the present exemplary embodiment, the below-described preferred embodiments are provided for forms or dimensions of the insulating member 6, the metal shell 4, the connecting terminal 5 and the intermediate shaft 3 so that the insulating member 6 may assuredly hold the rear end part 32 of the intermediate shaft 3 in the shaft hole 43 of the metal shell 4.

Figure 3:
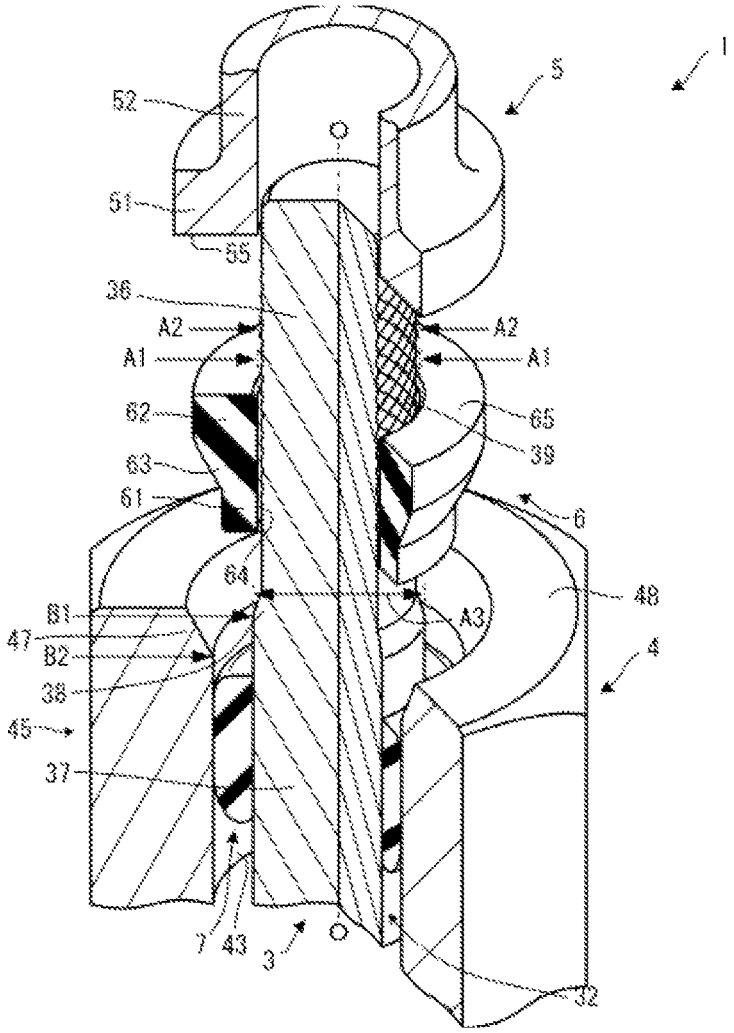
FIG. 3 shows perspective views and sections of members of an insulating member 6 during assembly.

As shown in FIG. 3, the inside diameter A1 of the tubular hole 64 of the insulating member 6 is formed to be larger than the outside diameter A2 (a maximum outside diameter including the engaging part 39) of the connecting end part 36 of the intermediate shaft 3. Thus, when the tubular hole 64 of the insulating member 6 is inserted onto the connecting end part 36 during an assembling operation of the glow plug 1, there is no concern of the inner periphery of the tubular hole 64 being rubbed and thereby broken by the engaging part 39 to which the knurling surface work has been applied.

On the other hand, the outside diameter A3 of the connecting base part 37 of the intermediate shaft 3 is formed to be larger than the outside diameter A2 of the connecting end part 36, and, in a state before the insulating member 6 is attached (namely, a state shown in FIG. 3), the outside diameter A3 is formed to be larger than the inside diameter A1 of the tubular hole 64 of the insulating member 6. When the insulating member 6 is inserted onto the connecting end part 36 and reaches the shoulder part 38, the inside diameter of the tubular hole 64 of the insulating member 6 is expanded by the tapered part of the shoulder part 38. When the insulating member 6 is further pushed in and arranged in the periphery of the connecting base part 37 as shown in FIG. 2, since the above-described relation of A1<A3 is established, the inner periphery of the tubular hole 64 of the insulating member 6 comes into close contact with the outer periphery of the connecting base part 37. Thus, since a gap is not formed between the insulating member 6 and the connecting base part 37, when the insulating member 6 is positioned and fixed in the shaft hole 43 in the rear end part 45 of the metal shell 4 (as described below), the rear end part 32 of the intermediate shaft 3 can be assuredly held.

Further, as shown in FIG. 2 and FIG. 3, an end position B2 (corresponding to a start position of an expansion of the tapered part 47 in the shaft hole 43) is arranged closer to the end side than an end position B1 (corresponding to a boundary between the shoulder part 38 and the connecting base part 37) of the shoulder part 38 of the intermediate shaft 3 in the axial direction O. As described above, when the insulating member 6 is arranged in the connecting base part 37 and further pushed in, the tapered part 63 provided in an outer peripheral surface of the insulating member 6 abuts the tapered part 47 provided in an inner peripheral surface of the shaft hole 43 in the rear end part 45 of the metal shell 4. Since the end position B2 is arranged closer to the end side than the end position B1, the insulating member 6 can be arranged closer to the end side of the connecting base part 37 until the tapered part 63 of the insulating member 6 abuts the tapered part 47 of the metal shell 4. Thus, an abutting area between an outer peripheral surface of the connecting base part 37 of the intermediate shaft 3 and an inner peripheral surface of the tubular hole 64 of the insulating member 6 can be increased.

Then, when the insulating member 6 is pushed in toward the axial direction O along the intermediate shaft 3 and the tapered part 63 of the insulating member 6 abuts the tapered part 47 of the metal shell 4, a resistance force is generated in a vertical direction to the abutting surface. The resistance force has a radial component. Further, since the inner periphery of the tubular hole 64 comes into close contact with the outer periphery of the connecting base part 37 as described above, the insulating member 6 is arranged in a state in which the radial resistance force (in other words, in a close contact state) is applied to each of the connecting base part 37 of the intermediate shaft 3 and the tapered part 47 of the metal shell 4. Then, as described above, in a state in which the insulating member 6 is pressed to the end side in the axial direction O by the connecting terminal 5, the connecting terminal 5 is crimped to the connecting end part 36 of the intermediate shaft 3. Thus, the tapered part 47 and the tapered part 63 are maintained in a close contact state. Since the insulating member 6 is fixed in the shaft hole 43 in the rear end part 45 of the metal shell 4 and the rear end part 32 of the intermediate shaft 3 is assuredly held by the insulating member 6, a deflection or bending of the intermediate shaft 3 can be prevented. Further, since the intermediate shaft 3 is assuredly held by the insulating member 6 in the rear end part 32, a stress (a load) applied to the ceramic heater 2 connected to the end part 31 can be reduced.

Further, as shown in FIG. 2, in a state in which the glow plug 1 is assembled, a maximum outside diameter D1 of the tapered part 47 of the metal shell 4 is formed so as to be larger than a maximum outside diameter D2 of the tapered part 63 of the insulating member 6. In a state in which the tapered part 63 of the insulating member 6 abuts the tapered part 47 of the metal shell 4, when the relation of D1>D2 is satisfied, an edge part formed by the rear end surface 48 and the tapered part 47 of the metal shell 4 is arranged radially outside the tapered part 63 of the insulating member 6. Therefore, since the edge part formed by the rear end surface 48 and the tapered part 47 does not butt against the insulating member 6 (especially, the tapered part 63) to apply a stress thereto, such arrangement can prevent the insulating member 6 from being cut or worn due to a concentration of stress.

Further, in a state in which the glow plug 1 is assembled, a maximum outside diameter D3 of the rear end surface 65 of the insulating member 6 is formed so as to be smaller than a maximum outside diameter D4 of the end surface 55 of the connecting terminal 5. Similarly, as described above, in a state in which the end surface 55 of the connecting terminal 5 abuts the rear end surface 65 of the insulating member 6, when the relation of D3<D4 is satisfied, an edge part formed by a side surface and the end surface 55 of the collar part 51 is arranged radially outside the rear end surface 65 of the insulating member 6. Accordingly, since the edge part formed by the side surface and the rear end surface 55 of the collar part 51 does not butt against the rear end surface 65 of the insulating member 6 to apply a stress thereto, such arrangement can prevent the insulating member 6 from being cut or worn due to a concentration of stress.

Figure 4:
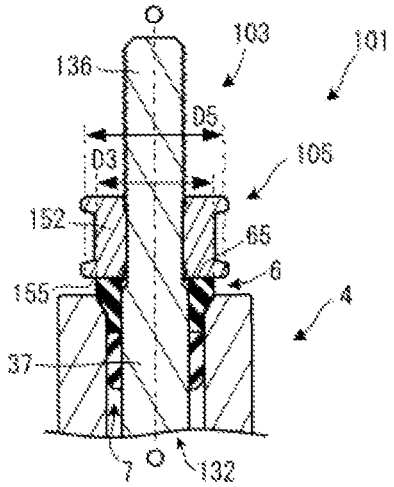
FIG. 4 is a sectional view showing an enlarged rear end side of a glow plug 101.

In the present invention, various modifications can be made. For instance, in the glow plug 101 shown in FIG. 4, the connecting terminal 5 (see FIG. 1) is not used, and a circular nut 105 may be inserted to a rear end part 132 of an intermediate shaft 103, crimped at a body part 152 while pressing an insulating member 6 to an end side in the axial direction O, and fixed to a connecting end part 136. Similar to the present exemplary embodiment, in a state in which the glow plug 101 is assembled, a maximum outside diameter D3 of a rear end surface 65 of the insulating member 6 may be smaller than a maximum outside diameter D5 of an end surface 155 of the circular nut 105. In the above-described modified example, the intermediate shaft 103 has screw threads provided in the connecting end part 136. However, in the vicinity of a part where the circular nut 105 is crimped and fixed, the screw threads are not provided. Further, its structure is not limited thereto, and the screw threads may be provided in a position where the circular nut 105 is crimped and fixed and the circular nut 105 may instead be fixed not by crimping, but by screwing. Otherwise, a separate member such as the connecting terminal 5 or the circular nut 105 need not be used. For instance, a part of the connecting end part 36 of the intermediate shaft 36 may be modified to press the insulating member 6 to the end side in the axial direction O and position and fix the insulating member so as to maintain the tapered part 47 and the tapered part 63 in a close contact state.

Further, in the above embodiment, the rear end surface 65 of the insulating member 6 is formed in a flat surface. However, the rear end surface 65 may be formed as a surface having a section of a circular arc and curved round a circumferential direction or as a surface provided with a plurality of irregularities. In such a case, a rear end surface comes into linear or point contact with an end surface 55 of a connecting terminal 5. However, in the present invention, not only a contact of the surfaces, but also a contact of a surface and a line or a contact of a surface and a point is referred to as an "abutment." Further, a maximum outside diameter D3 of the rear end surface of the insulating member is not to be taken as a maximum outside diameter in an entire part of a curved surface forming the rear end surface, but is taken as a maximum outside diameter in a part of a curved surface which can abut the end surface 55 of the connecting terminal 5 (a part located in a rear end in the axial direction O in the rear end surface). In other words, the part of the rear end surface of the insulating member which can abut the end surface 55 of the connecting member 5 may be located radially inside a range of the end surface 55. The part which can abut the end surface of the connecting terminal includes a part which can come into contact with the end surface 55 of the connecting terminal 5 due to elastic deformation of the rear end surface of the insulating member.

Figure 5:
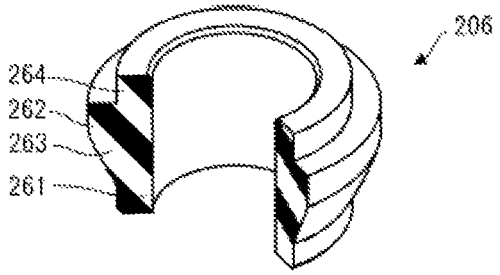
FIG. 5 shows a perspective view and a section of an insulating member 206.
Figure 6:
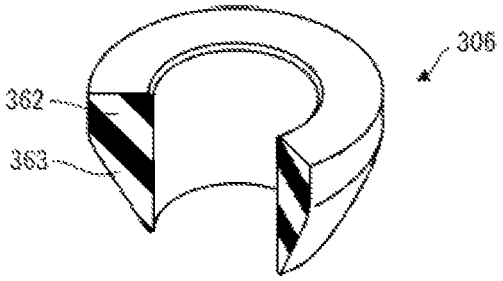
FIG. 6 shows a perspective view and a section of an insulating member 306.
Figure 7:
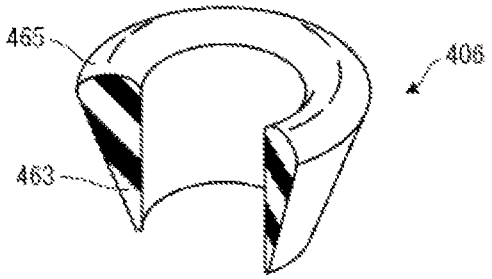
FIG. 7 shows a perspective view and a section of an insulating member 406.

Further, in the above embodiment, the insulating member 6 has the tapered part 63 between the end body part 61 and the rear end body part 62. However, for instance, in the insulating member 206 shown in FIG. 5, a tubular member which includes a terminal end part 264 having the same diameter as that of an end body part 261 is provided at a rear end side of a rear end body part 262 and extends from the end body part 261 to the terminal end part 264. Therein, a tapered part 263 and the rear end body part 262 may be formed in the shape of a flange. Otherwise, in the insulating member 306 shown in FIG. 6, an end body part is not provided, and an end side from a tubular rear end body part 362 may be formed as a tapered part 363. Otherwise, in the insulating member 406 shown in FIG. 7, a form may be used which does not have an end body part or a rear end body part, but only has a tapered part 463. For instance, a form may be used in which a tubular hole is formed in a conical body. The insulating member 406 shown in FIG. 7 illustrates an example in which a rear end surface 465 has a section of a circular arc and is curved round a circumferential direction as described above.

Further, in the above embodiment, the glow plug 1 is provided with the ceramic heater 2. However, the present invention is not limited thereto, and the glow plug may include a sheath heater having a coil shaped heat generating resistor or a control resistor in a sheath tube made of metal and having an end part that is hemi-spherically closed.

In the present exemplary embodiment, the ceramic heater 2 corresponds to a "heater." The end part 31 of the intermediate shaft 3 corresponds to one "end part" of the intermediate shaft and the connecting end part 36 of the rear end part 32 corresponds to "the other end part." The connecting terminal 5 or the circular nut 105 corresponds to a "fixing part." The insulating member 6 corresponds to an "insulator." The tapered part 47 of the metal shell 4 corresponds to a "first tapered part." A tapered part 63 of the insulating member 6 corresponds to a "second tapered part." These tapered parts do not need to completely abut each other on their entire parts. Accordingly, the second tapered part may have a structure larger than that of the first tapered part. Further, angles formed respectively by the tapered parts and the axis O need not completely correspond to each other. For instance, the angles formed by both the tapered parts may have a difference of about 5°.

This invention has been described in detail by reference to the above embodiment. However, the invention should not be construed as being limited thereto. It should further be apparent to those skilled in the art that various changes in form and detail of the invention as shown and described above may be made. It is intended that such changes be included within the spirit and scope of the claims appended hereto.

This application is based on Japanese Patent Application No. 2011-013384 filed Jan. 25, 2011, incorporated herein by reference in its entirety.

What is claimed is:

1. A glow plug comprising:

a heater having a heat generating resistor that generates heat by passing an electric current therethrough;

a metal shell formed in a tubular shape having a shaft hole extending in an axial direction and which directly holds the heater in a front end part thereof or indirectly through a holding member;

an intermediate shaft formed in the shape of a rod, arranged in the shaft hole of the metal shell with a clearance provided relative to an inner peripheral surface of the metal shell and which has one end part thereof connected to a rear end part of the heater and the other end part thereof protruding from a rear end of the metal shell; and a cylindrical insulator arranged between the shaft hole of the metal shell and the intermediate shaft , which insulator is urged toward the front end of the metal shell in the axial direction and positioned by a fixing part provided in the other end part of the intermediate shaft, further including:

a first tapered part that is provided in the inner peripheral surface of the metal shell in a rear end part of the metal shell and which expands from the shaft hole to an opening of the shaft hole; and a second tapered part that is provided in an outer peripheral surface of the insulator, expands from an end side to a rear end side of the insulator and abuts the first tapered part, wherein a rear end surface of the insulator abuts an end surface of the fixing part, and when a maximum outside diameter of the first tapered part of the metal shell is D1, a maximum outside diameter of the second tapered part of the insulator is D2, a maximum outside diameter of the rear end surface of the insulator is D3 and a maximum outside diameter of the end surface of the fixing part is D4, the relations of D1>D2 and D3<D4 are satisfied.

2. The glow plug according to claim 1, wherein the insulator is arranged between the shaft hole and the intermediate shaft in a state in which the insulator is in close contact with the intermediate shaft.

3. A method for manufacturing a glow plug which comprises a heater having a heat generating resistor that generates heat by passing an electric current therethrough;

a metal shell formed in a tubular shape having a shaft hole extending in an axial direction and which directly holds the heater in a front end part thereof or indirectly through a holding member;

an intermediate shaft formed in the shape of a rod, arranged in the shaft hole of the metal shell with a clearance provided relative to an inner peripheral surface of the metal shell and which has one end part thereof connected to a rear end part of the heater and the other end part thereof protruding from a rear end of the metal shell; and a cylindrical insulator arranged between the shaft hole of the metal shell and the intermediate shaft , which insulator is urged toward the front end of the metal shell in the axial direction and positioned by a fixing part provided in the other end part of the intermediate shaft, further including:

a first tapered part that is provided in the inner peripheral surface of metal shell in a rear end part of the metal shell and which expands from the shaft hole to an opening of the shaft hole; and a second tapered part that is provided in an outer peripheral surface of the insulator, expands from an end side to a rear end side of the insulator and abuts the first tapered part, wherein the intermediate shaft includes a connecting base part whose outside diameter is larger than that of the other end part of the intermediate shaft and a shoulder part having a taper that connects the other end part of the intermediate shaft to the connecting base part in a state before the insulator is arranged between the shaft hole of the metal shell and the intermediate shaft; an inside diameter A1 of a tubular hole of the insulator, an outside diameter A2 of the other end part of the intermediate shaft and an outside diameter A3 of the connecting base part satisfy a relation of A2<A1<A3; and an end position B1 of the shoulder part of the intermediate shaft is located closer to a rear end side in the axial direction than an end position B2 of the first tapered part of the metal shell, said method which includes arranging the insulator between the shaft hole of the metal shell and the intermediate shaft comprises:

an inserting step of providing the insulator around the other end part of the intermediate shaft;

an arranging step of pressing the insulator to the shoulder part so as to expand the tubular hole and arranging the insulator onto the connecting base part; and an abutting step that further pushes the insulator onto the connecting base part so that the second tapered part abuts the first tapered part of the metal shell.

4. The method according to claim 3, wherein the insulator is arranged between the shaft hole and the intermediate shaft in a state in which the insulator is in close contact with the intermediate shaft.

5. The method according to claim 3, wherein a rear end surface of the insulator abuts an end surface of the fixing part, and when a maximum outside diameter of the first tapered part of the metal shell is D1, a maximum outside diameter of the second tapered part of the insulator is D2, a maximum outside diameter of the rear end surface of the insulator is D3 and a maximum outside diameter of the end surface of the fixing part is D4, the relations of D1>D2 and D3<D4 are satisfied.

* * * * *